United States Patent [19]

Danielson et al.

[11] Patent Number: 4,864,905

[45] Date of Patent: Sep. 12, 1989

[54] MULTIPLE BANDMILL FOR MAKING A PLURALITY OF SAWLINES IN THE SAME LONGITUDINAL PLANE AT ONE TIME

[75] Inventors: Jeanne D. Danielson; David D. Lewis, both of New Glarus, Wis.

[73] Assignee: The United States of America as represented by the Secretary of Agriculture, Washington, D.C.

[21] Appl. No.: 297,786

[22] Filed: Jan. 17, 1989

[51] Int. Cl.[4] ..... B27B 15/08

[52] U.S. Cl. ..... 83/808; 125/21

[58] Field of Search ..... 83/808; 125/21

[56] References Cited

U.S. PATENT DOCUMENTS

| | | | |
|---|---|---|---|
| 552,614 | 1/1896 | Hutchinson . | |
| 684,919 | 10/1901 | Dees . | |
| 2,201,413 | 5/1940 | Turner . | |
| 2,696,253 | 12/1954 | Hartman . | |
| 2,984,275 | 5/1961 | Patterson . | |
| 4,061,066 | 12/1977 | Mueller | 83/808 |

OTHER PUBLICATIONS

McDonough Mfg. Co., 4-page brochure.

Robert R. Maeglin, R. Sidney Boone, Forest Prod. J., 33(3): 10–18, 1983.

*Primary Examiner*—Donald R. Schran

*Attorney, Agent, or Firm*—William J. Connors; M. Howard Silverstein

[57] ABSTRACT

A multiple bandmill (10) for sawing a log (L) moving past that multiple bandmill. This multiple bandmill includes two pairs of bandmills (20, 22 and 24, 26) located at a common longitudinal position with respect to a log being cut. The bandmills comprising the multiple bandmill are slanted with respect to vertical in the longitudinal direction. The bandsaw blades (50, 52 and 54, 56) of each pair of bandmills within the multiple bandmill cross each other in a X-pattern in the log cutting region (30). One bandmill (20, 26) of each pair is located within the area defined by the other bandmill (22, 24). All four sawlines (12, 14, 16, 18) are made at the same time at a single longitudinal location on the log.

10 Claims, 2 Drawing Sheets

MULTIPLE BANDMILL FOR MAKING A PLURALITY OF SAWLINES IN THE SAME LONGITUDINAL PLANE AT ONE TIME

TECHNICAL FIELD

The present invention relates generally to sawmilling, and more particularly to multiple bandmills for making several sawlines on a log in one pass.

BACKGROUND ART

Sawmills commonly saw logs or semifinished pieces of lumber, called cants, using multiple bandmills to make several sawlines in one pass, with the path of the moving log or cant oriented approximately parallel to its longitudinal centerline. The multiple bandmills presently used in sawmills commonly consist of one or two pairs of single bandmills.

A single bandmill consists of two large wheels of equal size, usually 4 feet to 10 feet in diameter with a bandsaw blade mounted thereon. One wheel, the bottom wheel, is usually mounted below the floor level of the sawmill. This wheel is mounted on an arbor which is turned by a motor. The second wheel, the top wheel, is mounted on an arbor which, in turn, is mounted on a columnular framework above the bottom wheel. Both wheels are usually mounted vehicle, with the radial direction of the wheel perpendicular to the direction of log or cant travel. The bandsaw blade, consisting of a flat band of steel made into an endless loop with sawteeth on one edge, is mounted on the two wheels. The rotation of the bottom wheel moves the bandsaw blade by frictional force. The moving bandsaw blade causes the top wheel to turn, also by friction. The path of travel of any tooth on the bandsaw blade, then, is described by semicircles at the bottom of the bottom wheel and the top of the top wheel joined by straight lines between the ends of the semicircles.

Because the bandsaw blade moves around the two wheels, the direction of sawblade travel is downward on one side and upward on the other. The actual cutting operation is performed on the side where the sawblade is traveling in the downward direction.

The sides of the bandmill are defined as the two sides where the wheels are viewed as a circle. The front and back of the bandmill are the two sides where the bandmill wheels are seen on edge, with the front being the side on which the bandsaw blade does the cutting.

Two or more single bandmills arranged to operate together as a unit are called a multiple bandmill. When two bandmills are arranged opposite each other with the fronts facing each other, the pair is called in a twin bandmill. Thus, when looking at the pair of bandmills, they appear to be mirror images of each other. The log or cant to be sawn is transported past the saws in a longitudinal direction with the center of the log or cant approximately on the longitudinal centerline of the unit. The twin bandmill, then, can make two sawlines in the log or cant at the same time, with the two sawlines generally being on opposites sides of the log or cant longitudinal centerline. The two bandsaw blades and the resulting sawlines in the log or cant are parallel. The cutting edges of the two bandsaw blades are in the same vertical plane, perpendicular to the direction of log or cant travel.

Commonly, two pairs of twin bandmills are arranged with one pair ahead of theother, so four parallel sawlines can be made at almost the same time. This arrangement is called a quad bandmill. The two pairs of bandmills comprising the quad bandmill are separated longitudinally along the sawing path by typically one and one-half feet to as much as six or eight feet. The longitudinal separation between the two pairs of bandmills is necessary to accommodate the width of the wheels, the supporting columns, and the arbors on which the wheels are mounted.

When sawing a log with a quad bandmill, the first pair of saws cutting the log makes the two sawlines closest to the outside of the log, while the second pair makes the two sawlines closest to the center of the log. It is this longitudinal separation of the two pairs of bandmills comprising the quad bandmill which leads to some of the inaccuracy in the dimensions of the sawn lumber manufactured on the quad bandmill, for reasons described below. This inaccuracy is prevented by the present invention.

As a tree grows, tension stresses develop in the newly formed xylem, see for instance, Forest Products Journal 33(3) 10, 1983. With the formation of subsequent annual growth rings, the area of tension stress expands and induces compression stresses in the center of the tree. The result is a continuum of stresses, called growth stresses, radially across the tree, with tension stresses at the outside, decreasing to a neutral zone approximately one-third of the way to the center of the tree, and changing to compression stresses which are greatest at the pith. When a log from the tree is sawn into lumber, the cutting of the wood fibers by the saw relieves some of these stresses. This stress relief causes lumber sawn from the log to warp while the unsawn portion of the log moves with respect to its initial position in the sawing system. When logs are sawn using a quad bandmill, the initial two cuts by the first pair of bandmills relieve some of the stresses, thus allowing the remainder of the log to move from its original position prior to sawing by the second pair of bandmills. The growth stresses are not necessarily uniform within a given tree, and vary in both magnitude and location from tree to tree. Thus, the amount of log movement in sawing varies erratically and unpredictably.

The quad bandmills are set up so the sawlines from all four bandmills are parallel and spaced apart by the target thickness of the lumber. Since the log moves unpredictably relative to the saws, the dimensions of the lumber manufactured from it will also vary. To account for this variation, additional thickness is added to the lumber target size so no lumber is manufactured too thin. In this manner, undersized lumber is prevented, but the addition of thickness means some lumber is manufactured oversized, which wastes wood fiber and reduces lumber yield from each log.

If all four sawlines were made at the same longitudinal location at one time, growth stress relief would still occur, but since sawing would be completed, the resulting log movement would have no effect on the accuracy of the lumber. However, this is impossible to accomplish with existing quad bandmills because of the distance required between the pairs of bandmills.

OBJECTS OF THE INVENTION

It is a main object of the present invention to provide a new and novel multiple bandmill for sawing logs and cants which eliminates lumber size variation caused by relief of growth stresses.

It is another object of the present invention to provide a new and improved multiple bandmill for making at least two sawlines simultaneously at a single longitudinal location and on the same side of center in the transverse direction on a log or cant being processed.

It is another object of the present invention to provide a new and improved multiple bandmill in which two bandmills are arranged side-by-side in a manner which permits the bandmill drive wheels to be easily accomodated, while permitting the two sawlines to be made in the same longitudinal location and in the same side of the transverse center line of the log or cant.

It is another object of the present invention to provide a new and improved multiple bandmill which includes a plurality of pairs of bandmills with the bandmills being vertically slanted whereby the sawblades of the bandmills cross beside each other in the sawing region. One of the crossed bandsaw blades is positioned within the loop of the other bandsaw blade on the same side of the unit.

DISCLOSURE OF THE INVENTION

These objects are accomplished by providing a multiple bandmill arranged so that at least two bandsaw blades are arranged at a common longitudinal location and on the same side of the transverse center line of the log or cant sawing path. Thus, two or more sawlines can be made at the same time so growth stress relief does not cause log or cant movement during the cutting operation. In this manner, the sawn lumber need not be oversized to account for size variation caused by this movement, thereby conserving wood fiber.

In order to locate the cutting tooth edges of all the saws on the same side of the log or cant side-by-side at a common longitudinal location, it is necessary to configure the bandmills so that the wheels and supporting columns do not interfere with each other. This is accomplished by slanting the bandmills with respect to vertical and orienting them so that the bandsaw blades of each pair of bandmills cross beside each other in the cutting area. Since bandsaw blades are in the form of an endless loop, this crossing can only be accomplished by inserting the loop of one bandsaw blade of each pair through the loop of the other. The separation of the two bandsaw blades of each pair, needed to accomodate the lumber target thickness between the two sawlines and to allow free movement of the bandsaw blades, is accomplished by making the top and bottom wheels of one bandmill smaller than those of the other bandmill in that pair.

The configuration of the slanted bandmills is such that the drive wheels and drive mechanism for the wheels are similar to that of conventional quad bandmills and need not be extensively redesigned to accommodate the crossed bandsaw blade of the present invention. The supporting columns and arrangement of the wheels would be readily apparent modifications from those used with conventional bandmills and would be a design choice by one skilled in the art.

DETAILED DESCRIPTION OF A PREFERRED EMBODIMENT

Figure 1:
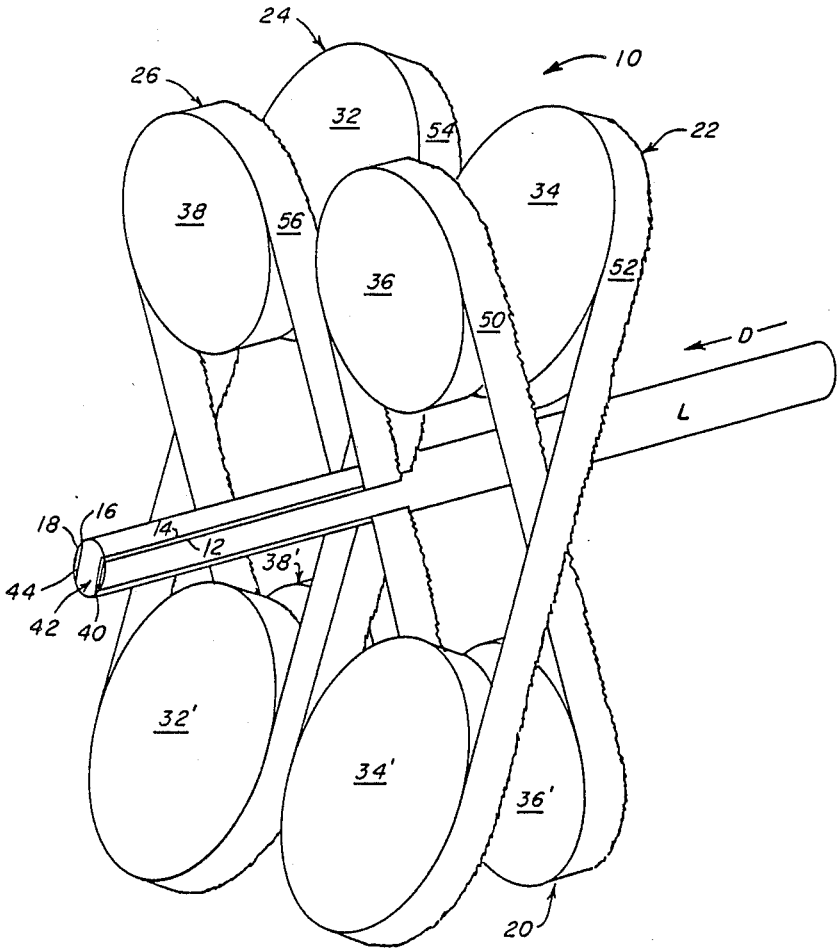
FIG. 1 is a perspective schematic of a multiple bandmill which uses two pairs of crossed bandsaw blades to cut a log or cant.

FIG. 1 shows a schematic of the multiple bandmill 10 described by the present invention making four sawlines in a log L. The log is moving in a direction indicated by arrow D, with the upstream and downstream direction in the description of the multiple bandmill taken with respect to the direction of log travel.

Figure 2:
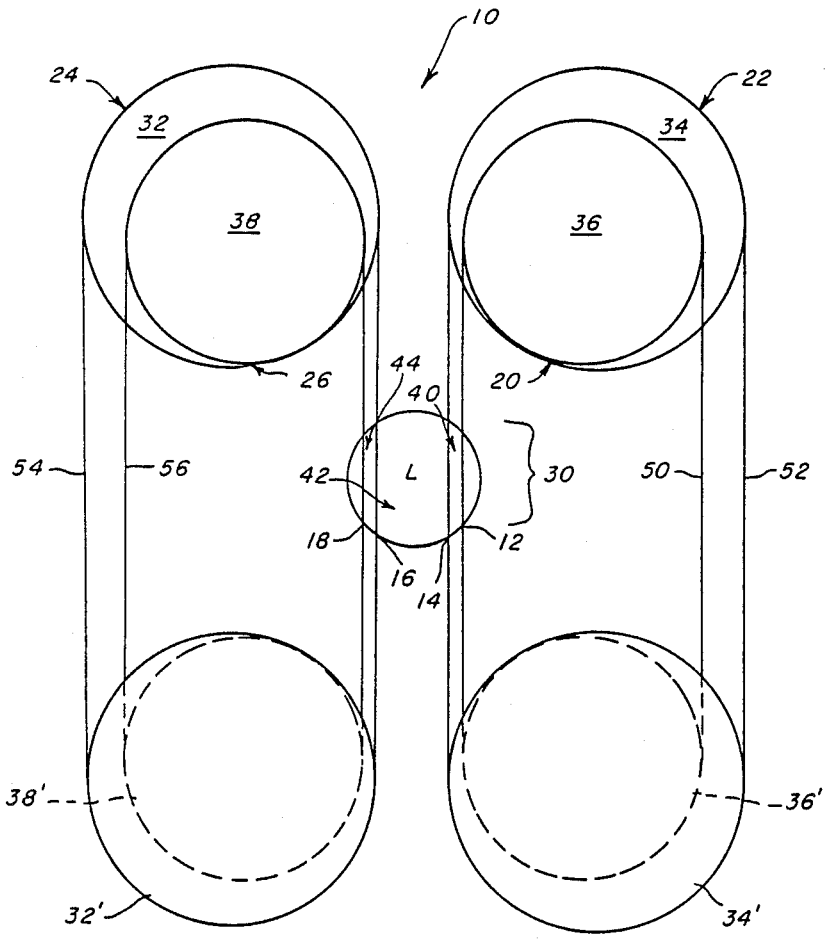
FIG. 2 is one side view of a multiple bandmill of FIG. 1 showing the transverse positioning of the bandsaw blades on a log being sawn.
Figure 3:
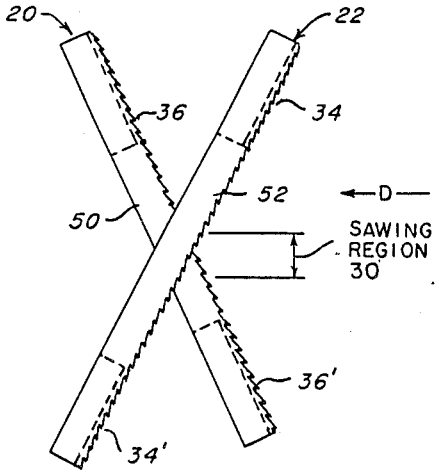
FIG. 3 is a plan view of a multiple bandmill incorporating a pair of bandsaw blades which are crossed in the cutting zone and operating on the same side of the tranverse center line of the log.

Referring to FIGS. 1 and 2, the multiple bandmill consists of four individual bandmills, 20, 22, 24, and 26. It is understood, however that a single bandmill pair such as 20 and 22 satisfy the requirements of this invention and is shown in FIG. 3. These are arranged in pairs with individual bandmills 20 and 22 comprising the pair to the right of the multiple bandmill centerline and bandmills 24 and 26 comprising the pair to the left, looking at the multiple bandmill from downstream.

Each bandmill, 20, 22, 24, and 26, has a bandsaw blade, 50, 52, 54, and 56 respectively, mounted on wheels. Each bandsaw blade has teeth arranged on the upstream edge which do the actual cutting of the log. These bandsaw blades cut sawlines 12, 14, 16, and 18 respectively. The bandmills are oriented so the width of the bandsaw blades is parallel to the direction of log or cant travel. The four bandmills are spaced apart in the log transverse direction by having one pair of bandmills on each side of the multiple bandmill longitudinal centerline and by having the wheels of one bandmill of each pair smaller than the wheels of the other bandmill in that pair. Thus, the sawline made by each bandsaw blade extends the length of the log and all four sawlines are parallel.

Each of the four bandmills, 20, 22, 24, and 26, has top wheels, 36, 34, 32, and 38 and associated bottom wheel, 36', 34', 32', and 38' respectively. Shown in FIG. 3, for a twin bandmill of this invention the wheels of the bandmills are slanted with respect to vertical in the longitudinal direction so that the bandsaw blades mounted on them cross beside each other, forming a "X" shape in the cutting area 30. Wheels 36 and 36' of bandmill 20 and wheels 38 and 38' of bandmill 26 are slanted with the highest part of the wheel in the downstream direction from vertical while wheels 34 and 34' of bandmill 22 and wheels 32 and 32' of bandmill 26 are slanted upstream. Each wheel is slanted at approximately a 15 degree angle from vertical, but the exact angle depends on the diameters of the wheels and dimensions of the supporting columns and is not critical to the design of the multiple bandmill. The objects of the invention are best accomplished by having the wheels as close together as possible and the angle as small as possible. while FIGS. 1 and 3 show each bandmill of a bandmill pair being slanted from the verticle direction of the longitudinal axis of the log, it is to be understood that a multiple bandmill may comprise a verticle bandmill with one or more bandmills at an angle to verticle.

The wheels of one individual bandmill within each pair are smaller in diameter than the wheels of the other bandmill in that pair. Thus, wheels 36 and 36' are smaller than wheels 34 and 34' in bandmill pair 20-22 and wheels 38 and 38' are smaller than wheels 32 and 32' in bandmill pair 26-24. This is done so the bandsaw blades of the two bandmills within each pair are separated by the thickness of lumber pieces 40 and 44 respectively, which thickness can be varied by moving the smaller bandmill of each pair in a transverse direction. Also, the two bandmills within each pair may be moved simultaneously in a transverse direction to vary the thickness of the center lumber piece 42. Relative or mutual adjustment of bandmills is well known to one skilled in the art.

In order to accomodate the crossed bandsaw blades of the present invention, the loop of the smaller bandsaw blades of each pair, blades 50 and 56, pass through the loop of the larger bandsaw blades, blades 52 and 54. The bandsaw blades are mounted on the wheels of the bandmill in the same manner as on conventional bandmills.

ADDITIONAL EMBODIMENTS

Two additional bandmills arranged vertically, as with conventional bandmills, can be located with each pairs of slanted bandmills. This arrangement will permit making six sawlines simultaneously, at a single longitudinal location on the log or cant, three on each side of the multiple bandmill centerline. The wheels of the third bandmill on each side of the centerline are of a larger size than those of the slanted bandmills, permitting the loops of bandsaw blades of the two slanted bandmills on that side to pass through the loop of the third, vertical bandmill.

All the single bandmills of the described multiple bandmill may also be slanted in the transverse direction at the same time. This will allow the feed system to be slanted so the sawn pieces are transported away by gravity. This transverse slant to bandmills is presently used with conventional bandmills.

What is claimed is:

1. A multiple bandmill for defining a plurality of sawlines in a log having longitudinal and transverse directions, each bandmill of said multiple bandmill having a continuous bandsaw blade, wheel means for mounting said blade, drive means for driving said blade, and support means for supporting said wheels, wherein the improvement comprises: at least two bandmills, each bandmill having a continuous bandsaw blade, wherein the mounted blade of one bandmill is driven within a loop defined by the mounted blade of the second bandmill, said blades being mounted and driven to define sawlines simultaneously at a common longitudinal position on a log, and being spaced apart in the transverse direction.

2. The multiple bandmill defined in claim 1 wherein each of said bandmills is slanted with respect to vertical of the log longitudinal direction.

3. The multiple bandmill defined in claim 2 further including a vertical bandmill with respect to the vertical of the log longitudinal direction, wherein the mounted bandsaw blades of the slanted bandmills are driven through the loop defined by the mounted bandsaw blade of the vertical bandmill.

4. The multiple bandmill defined in claim 1 wherein one of said bandmills is vertical and one of said bandmills forms an angle to verticle of the log longitudinal direction.

5. The multiple bandmill as defined in claim 1 wherein said wheels of one bandmill within each pair of bandmills have a circumference smaller than the wheels of said second bandmill of said pair.

6. A multiple bandmill for defining a plurality of sawlines in a log having longitudinal and transverse directions, each bandmill of said multiple bandmill having a continuous bandsaw blade, wheels means to mount said blades, drive means to drive said blades and support means to support said weels, the improvement comprising:

Three or more bandmills, each of said bandmills having a continuous bandsaw blade and wherein the mounted blade of smaller length is driven within the loop defined by the blade second in length and wherein said mounted blade second in length is driven within the loop defined by the loop of the blade longest in length, said blades being mounted and driven to define a plurality of sawlines at a common longitudinal position on a log and being spaced apart in the log transversal direction.

7. The multiple bandmill defined in claim 1, wherein the entire multiple bandmill is slanted from vertical in the transverse direction to the log.

8. The multiple bandmill defined in claim 6 wherein the entire multiple bandmill is slanted from vertical in the transverse direction to the log.

9. The multiple bandmill defined in claim 1 wherein said sawlines defined by said bandmill pair are on the same side of the log transverse center line.

10. The multiple bandmill defined in claim 6 wherein said sawlines defined by said bandmill pail are on the same side of the log transverse center line.

* * * * *